US009988794B2

(12) United States Patent
Miura et al.

(10) Patent No.: US 9,988,794 B2
(45) Date of Patent: Jun. 5, 2018

(54) FLOW RATE SETTING SYSTEM OF WORKING MACHINE

(71) Applicant: KUBOTA CORPORATION, Osaka (JP)

(72) Inventors: Keisuke Miura, Sakai (JP); Ryosuke Kinugawa, Osaka (JP)

(73) Assignee: KUBOTA CORPORATION, Osaka (JP)

( * ) Notice: Subject to any disclaimer, the term of this patent is extended or adjusted under 35 U.S.C. 154(b) by 207 days.

(21) Appl. No.: 14/858,318

(22) Filed: Sep. 18, 2015

(65) Prior Publication Data

US 2016/0091002 A1 Mar. 31, 2016

(30) Foreign Application Priority Data

Sep. 30, 2014 (JP) ..... 2014-202394

(51) Int. Cl.

*E02F 9/26* (2006.01)
*E02F 3/96* (2006.01)
*E02F 9/20* (2006.01)

(52) U.S. Cl.

CPC ..... *E02F 9/265* (2013.01); *E02F 3/96* (2013.01); *E02F 9/2012* (2013.01)

(58) Field of Classification Search

CPC ..... E02F 9/265; E02F 9/2012; E02F 3/96
USPC ..... 701/50
See application file for complete search history.

(56) References Cited

U.S. PATENT DOCUMENTS 9,776,221 B2 * 10/2017 Hoshikawa ..... B08B 9/02
2011/0258996 A1 * 10/2011 Ingersoll ..... F02C 6/16 60/421
2014/0277962 A1 * 9/2014 Lougheed ..... G05B 19/04 701/50

(Continued)

FOREIGN PATENT DOCUMENTS

JP H11158940 A 6/1999
JP 2009-235720 10/2009

OTHER PUBLICATIONS

Notification of Reasons for Refusal in Japanese counterpart Application No. 2014-202394, dated Dec. 12, 2017.

*Primary Examiner* — Anne M Antonucci
*Assistant Examiner* — James E Stroud
(74) *Attorney, Agent, or Firm* — Greenblum & Bernstein, P.L.C.

(57) ABSTRACT

A flow rate setting system of a working machine, includes: an attachment configured to be attached to the working machine; a control part configured to control a flow of hydraulic operation fluid based on a maximum flow rate of the hydraulic operation fluid being to be supplied to the attachment, the control part being mounted on the working machine; and a mobile terminal configured to communicate in wireless communication, the mobile terminal including: a first obtaining part configured to obtain identification information, the identification information being used for identifying the attachment; a second obtaining part configured to obtain the maximum flow rate of the attachment; and an output part configured to output the identification information and the maximum flow rate to the working machine in the wireless communication, the identification information being obtained by the first obtaining part, the maximum flow rate being obtained by the second obtaining part.

12 Claims, 11 Drawing Sheets

(56) References Cited

U.S. PATENT DOCUMENTS

2016/0052186 A1* 2/2016 de Oliveira Antunes
..... B29C 45/76
700/220

* cited by examiner

| Identification information | Level setting (Lv) | |
|---|---|---|
| | First solenoid valve | Second solenoid valve |
| JNK2488925 | 6 | 8 |

| Identification information | Setting flow rate (l/min) | |
|---|---|---|
| | First solenoid valve | Second solenoid valve |
| JNK2488925 | 35 | 50 |

FLOW RATE SETTING SYSTEM OF WORKING MACHINE

CROSS-REFERENCE TO RELATED APPLICATIONS

The present application claims priority under 35 U.S.C. § 119 to Japanese Patent Application No. 2014-202394, filed Sep. 30, 2014. The contents of this application are incorporated herein by reference in their entirety.

BACKGROUND OF THE INVENTION

Field of the Invention

The present invention relates to a flow rate setting system of a working machine such as a backhoe, a skid steer loader, a track loader, and a compact track loader.

Description of Related Art

A working machine disclosed in Japanese Unexamined Patent Application Publication No. 2009-235720 is previously known as a technique for setting the maximum flow rate supplied to various attachments.

Japanese Unexamined Patent Application Publication No. 2009-235720 includes a flow rate restriction setting means for variably setting the maximum flow rate level of a hydraulic operation oil, and the maximum flow rate level can be set corresponding to various types of the attachments by the flow rate restriction setting means.

BRIEF SUMMARY OF THE INVENTION

Problems to be Solved by the Invention

In Japanese Unexamined Patent Application Publication No. 2009-235720 (Patent Document 1), a display device disposed on a working machine reads a preliminarily-stored image of an attachment after setting a control part to a flow rate restriction setting mode, and a figure of a predetermined attachment is displayed on the display device. Then, the maximum flow rate of the attachment can be set by operating a switch of the display device, the attachment corresponding to the displayed figure.

An operator usually owns various types of attachments and desires to easily set the maximum flow rate to the owned attachments. In Japanese Unexamined Patent Application Publication No. 2009-235720 (Patent Document 1), the maximum flow rate of the attachment can be set by using the display device; however, in particular, the attachment owned by the operator sometimes is not preliminarily stored, and accordingly the operation to set the maximum flow rate sometimes is inconvenient.

To solve the above mentioned problems, the present invention intends to provide a flow rate setting system capable of easily setting the maximum flow rate of an attachment by using a mobile terminal.

Means of Solving the Problems

To solve the above-mentioned technical problems, techniques that the present invention provides are characterized in the following points.

In a first aspect of the present invention, a flow rate setting system of a working machine, includes: an attachment configured to be attached to the working machine; a control part configured to control a flow of hydraulic operation fluid based on a maximum flow rate of the hydraulic operation fluid being to be supplied to the attachment, the control part being mounted on the working machine; and a mobile terminal configured to communicate in wireless communication, the mobile terminal including: a first obtaining part configured to obtain identification information, the identification information being used for identifying the attachment; a second obtaining part configured to obtain a maximum flow rate of the attachment; and an output part configured to output the identification information and the maximum flow rate to the working machine in the wireless communication, the identification information being obtained by the first obtaining part, the maximum flow rate being obtained by the second obtaining part.

In a second aspect of the present invention, the mobile terminal includes: a relation part configured to relates the identification information of the attachment and the maximum flow rate to each other, the identification information being obtained by the first obtaining part, the maximum flow rate being obtained by the second obtaining part, and the output part outputs the identification information and the maximum flow rate both related to each other by the relation part.

In a third aspect of the present invention, the attachment includes a code showing: the identification information; and information showing the maximum flow rate, and the mobile terminal includes: an image part configured to image the code; and an extraction part configured to extract the identification information and the maximum flow rate from the code imaged by the imaging part.

In a fourth aspect of the present invention, the image part images the attachment separately from the code, and the relation part relates the identification information, the maximum flow rate, and an image of the attachment to each other, the image being taken by the image part.

In a fifth aspect of the present invention, the mobile terminal includes: a registration part configured to register the identification information and the maximum flow rate, and the output part outputs the identification information and the maximum flow rate each registered by the registration part.

In a sixth aspect of the present invention, the mobile terminal includes: a display part configured to display: the identification information and the maximum flow rate each registered by the registration part; or a name of the attachment and the maximum flow rate each obtained from the identification information, the identification information being related to the maximum flow rate by the relation part.

In a seventh aspect of the present invention, the display part displays a choice part used for choosing the attachment, and the output part outputs: the identification information corresponding to the attachment chosen by the choice part; and the maximum flow rate related to the identification information.

In an eighth aspect of the present invention, a flow rate setting system of a working machine, includes: an attachment configured to be attached to the working machine; a control part configured to control a flow of hydraulic operation fluid based on a level corresponding to a maximum flow rate of the hydraulic operation fluid being to be supplied to the attachment, the control part being mounted on the working machine; and a mobile terminal configured to communicate in wireless communication, the mobile terminal including: a first obtaining part configured to obtain identification information, the identification information being used for identifying the attachment; a second obtaining part configured to obtain the level of the attachment; and an output part configured to output the identification information and the level to the working machine in the wireless communication, the identification information being obtained by the first obtaining part, the level being obtained by the second obtaining part.

In a ninth aspect of the present invention, the mobile terminal includes: a relation part configured to relates the identification information of the attachment and the level to each other, the identification information being obtained by the first obtaining part, the level being obtained by the second obtaining part, and the output part outputs the identification information and the level both related to each other by the relation part.

In a tenth aspect of the present invention, the attachment includes a code showing: the identification information; and information showing the level, and the mobile terminal includes: an image part configured to image the code; and an extraction part configured to extract the identification information and the level from the code imaged by the image part.

In an eleventh aspect of the present invention, the image part images the attachment separately from the code, and the relation part relates the identification information, the level, and an image of the attachment to each other, the image being taken by the image part.

In a twelfth aspect of the present invention, the mobile terminal includes: a registration part configured to register the identification information and the level, and the output part outputs the identification information and the level each registered by the registration part.

In a thirteenth aspect of the present invention, the mobile terminal includes: a display part configured to display: the identification information and the level each registered by the registration part; or a name of the attachment and the level each obtained from the identification information, the identification information being related to the level by the relation part.

In a fourteenth aspect of the present invention, the display part displays a choice part used for choosing the attachment, and the output part outputs: the identification information corresponding to the attachment chosen by the choice part; and the level related to the identification information.

Effects of the Invention

According to the present invention, the maximum flow rate of an attachment can be easily set by using a mobile terminal.

DESCRIPTION OF THE EMBODIMENTS

Referring to drawings, preferred embodiments of flow rate setting systems of the present invention will be described below.

First Embodiment

An overall configuration of a working machine according to the embodiment will be described first.

Figure 15:
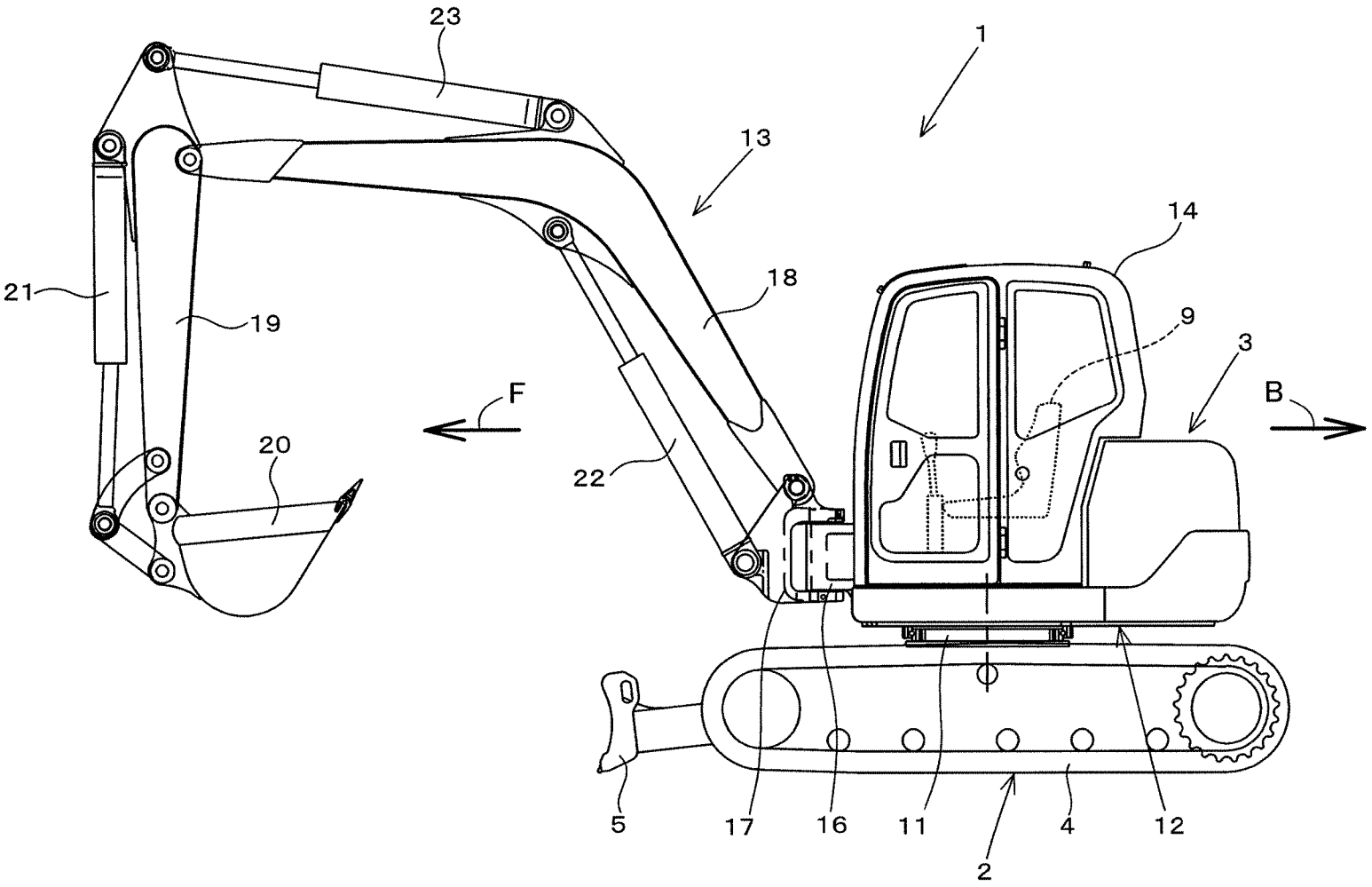
FIG. 15 is an overall view showing a side surface of a backhoe according to the embodiments of the present invention.

As shown in FIG. 15, the working machine 1 includes: a travel device 2 disposed on a lower portion of the working machine 1; and a turn body 3 disposed on an upper portion of the working machine 1. Meanwhile, a backhoe is shown as an example of the working machine 1 in FIG. 15; however, the working machine 1 is not limited to the backhoe, and accordingly may be a Skid Steer Loader (SSL), a Compact Track Loader (CTL), and a Tractor, for example. Hereinafter, in explanations of the embodiment of the present invention and in explanations of the modified examples of the embodiment, a forward direction (a direction shown by an arrowed line F in FIG. 15) corresponds to a front side of an operator seating on the operator seat of the working machine 1, a backward direction (a direction shown by an arrowed line B in FIG. 15) corresponds to a back side of the operator, a leftward direction (a direction from a back surface of FIG. 15 toward the front surface) corresponds to a left side of the operator, and a rightward direction (a direction from the front surface of FIG. 15 toward the back surface) corresponds to a right side of the operator.

The travel device 2 includes a pair of travelers 4 each having rubber crawler belts, one of the travelers 4 is disposed on a right side of the working machine 1, and the other one of the travelers 4 is disposed on a left side of the working machine 1. The travel device 2 employs a crawler type travel device configured to drive the travelers 4 by using a travel motor. A dozer unit 5 is disposed on a front portion of the travel device 2.

A turn unit 3 includes a turn base 12 and a working unit 13 (an excavation unit). The turn base 12 is supported on the travel device 2 by a turn bearing 11, and is capable of freely turning about a vertical axis of the turn bearing 11. The working unit 13 is disposed on a front portion of the turn base 12. An engine 7, a radiator 8, an operator seat 9, a fuel tank, a hydraulic operation oil tank, and the like are mounted on the turn base 12. In addition, a cabin 14 is mounted on the turn base 12, the cabin 14 surrounding the operator seat 9.

The working unit 13 includes a swing bracket 17, a boom 18, an arm 19, and a bucket 20. The swing bracket 17 is supported by a swing bracket 16 disposed on the front portion of the turn base 12, and is capable of freely swinging. In addition, the swing bracket 17 is connected to a swing cylinder disposed inside the turn base 12. The boom 18 is supported by the support bracket 16, and is capable of freely swinging upward and downward. The boom 18 is swung by stretching and shortening of a boom cylinder 22, the boom cylinder 22 being installed between the boom 18 and the swing bracket 17. The arm 19 is supported by the boom 18, and is capable of freely swinging upward and downward. The arm 19 is swung by stretching and shortening of an arm cylinder 23, the arm cylinder 23 being installed between the arm 19 and the boom 18. The bucket 20 is supported by the arm 19. The bucket 20 is swung by stretching and shortening of a bucket cylinder 21, the bucket cylinder 21 being installed between the bucket 20 and the arm 19.

An attachment such as a grapple, a thumb, a breaker, a brush cutter, a tilt bucket, or a rotary grapple, instead of the bucket 20, can be attached to a tip end portion of the arm 19. The attachments such as the grapple, the thumb, the breaker, the brush cutter, the tilt bucket, and the rotary grapple each attached instead of the bucket 20 are referred to as an auxiliary attachment, for convenience in the explanation.

A hydraulic operation oil supply unit (not shown in the drawings) is disposed on the tip end portion of the arm 19, the hydraulic operation oil unit being configured to supply a hydraulic operation oil (a hydraulic operation oil) to an actuator for operating the auxiliary attachment (hereinafter also referred to as an auxiliary actuator).

Figure 2:
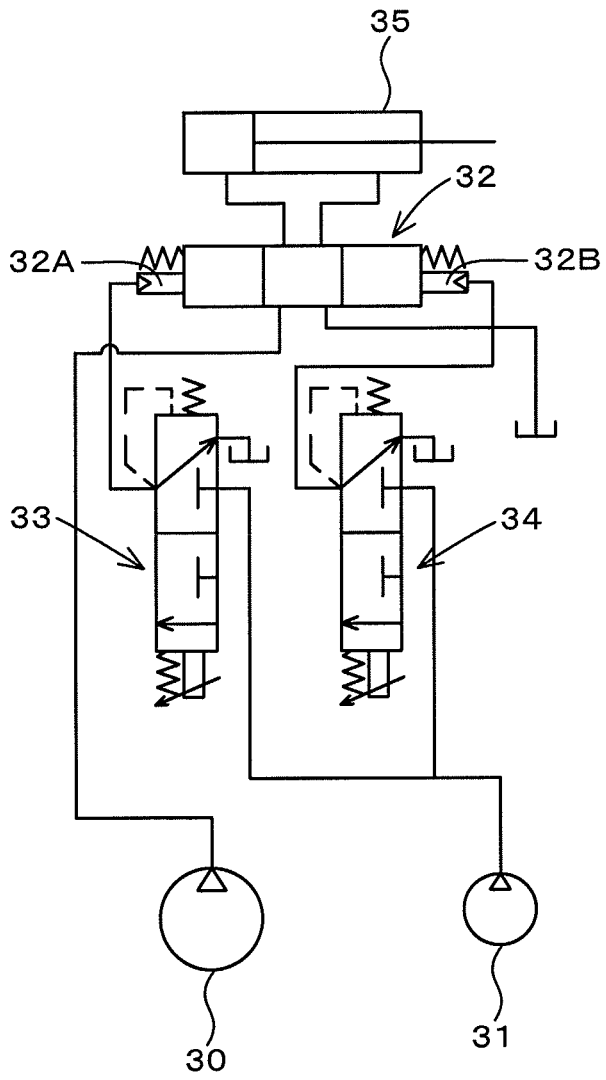
FIG. 2 is a schematic view of a hydraulic system according to the first embodiment.

FIG. 2 shows a diagram of a hydraulic circuit (a hydraulic system) for operating the auxiliary actuator.

At first, the hydraulic system will be explained.

As shown in FIG. 2, the hydraulic system is mounted on the working machine 1, and includes a first pump 30, a second pump 31, a control valve 32, and a pair of solenoid valves 33 and 34.

The first pump 30 is a device configured to discharge a hydraulic operation oil for operating an actuator such as an auxiliary actuator 35. The control valve 32 is a valve connected to the first pump 30 and the auxiliary actuator 35, the control valve 32 being configured to control a flow rate of the hydraulic operation oil discharged from the first pump 30 to supply the hydraulic operation oil to the auxiliary actuator 35. The flow rate of the hydraulic operation oil flowing from the control valve 32 to the auxiliary actuator 35 varies depending on a pilot pressure of a pilot oil (a pilot oil), the pilot pressure applied to a spool of the control valve 32.

The second pump 31 is a device configured to discharge the pilot oil, the pilot oil being a hydraulic operation oil for control and a hydraulic operation oil for signal. Each of the solenoid valves 33 and 34 is a valve configured to change an opening position of the valve, the opening position varying depending on a control signal (an electric current) applied to a solenoid included in each of the solenoid valves 33 and 34. The solenoid valve 33 (hereinafter also referred to as a first solenoid valve 33), one of the pair of solenoid valves 33 and 34, is connected to the second pump 31 and to a spool 32A (hereinafter also referred to as a first spool 32A), the spool 32A being one of the spools of the control valve 32. The solenoid valve 34 (hereinafter also referred to as a second solenoid valve 34), the other one of the pair of solenoid valves 33 and 34, is connected to the second pump 31 and to a spool 32B (hereinafter also referred to as a second spool 32B), the spool 32B being the other one of the spools of the control valve 32.

The first solenoid valve 33 changes the opening position of the first solenoid valve 33, and thus controls a pressure of the pilot fluid (the pilot pressure) discharged from the second pump 31 to apply the pressure to the first spool 32A of the control valve 32. The second solenoid valve 34 changes the opening position of the second solenoid valve 34, and thus controls the pilot pressure discharged from the second pump 31 to apply the pressure to the second spool 32B of the control valve 32.

Figure 1:
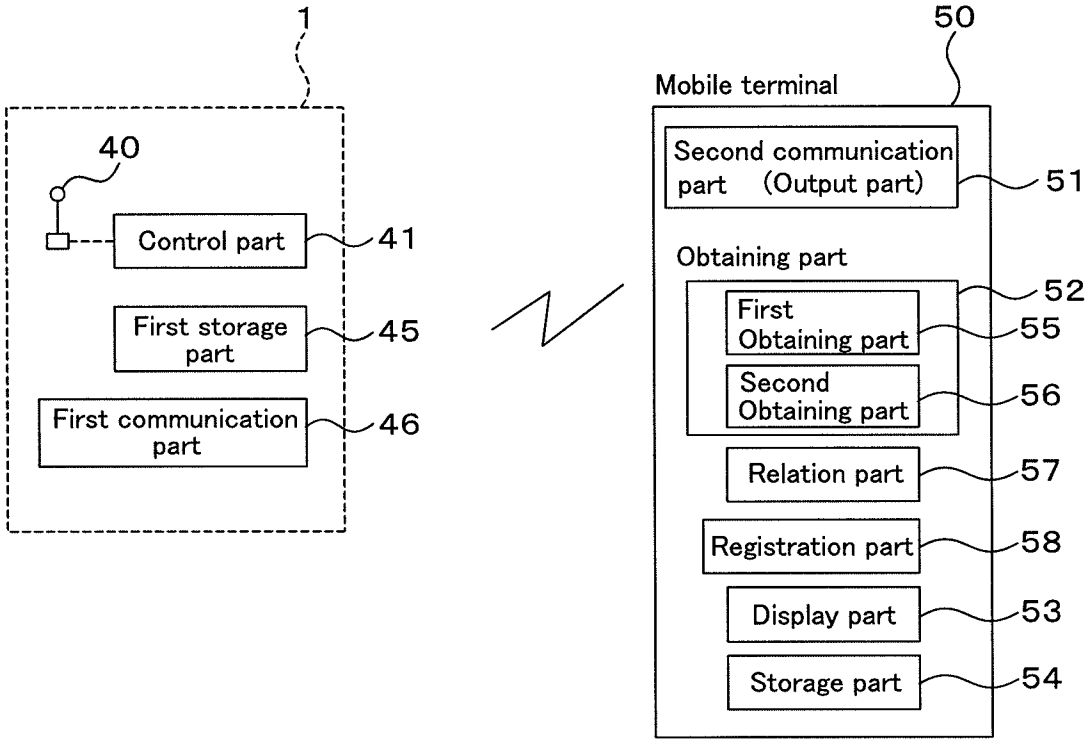
FIG. 1 is an overall view of a flow rate setting system for a working machine according to a first embodiment of the present invention.

FIG. 1 shows an overall view of the flow rate setting system for the working machine 1.

As shown in FIG. 1, the flow rate setting system includes an operation member 40 and a control part 41.

The operation member 40 is disposed on the working machine 1. The operation member 40 is a device used for operating the auxiliary attachment, that is, the auxiliary actuator 35. The operation member 40 is constituted of: a lever configured to be freely swung; a seesaw switch configured to be freely swung like a seesaw; a slide switch configured to be freely slid; a push switch configured to be freely pushed; and the like. An operation amount (for example, an operation angle θ) of the operation member 40 is detected by a position meter, a sensor, or the like, the position meter and the sensor being disposed on the operation member. The operation amount having been detected is inputted to the control part 41.

The control part 41 is disposed on the working machine 1. The control part 41 is constituted of a CPU or the like, and sets an output (for example, an electric current value) of a control signal on the basis of the operation amount of the operation member 40. Here, for convenience in the explanation, assuming that the operation member 40 is a lever configured to be swung rightward and leftward, a control by the control part 41 will be explained.

In a case where the operation member 40 is swung leftward from a neutral position, the control part 41 outputs an electric current I (a control signal) of a predetermined value to a solenoid of the first solenoid valve 33 on the basis of the operation angle θ of the operation member 40. In this manner, the first solenoid valve 33 is opened depending on the electric current value I, and thus the pilot pressure is controlled, the pilot pressure being applied to the first spool 32A of the control valve 32. Accordingly, when the first solenoid valve 33 is operated depending on the operation angle θ of the operation member 40, the first spool 32A of the control valve 32 moves, thereby moving the auxiliary actuator 35 in one direction.

In a case where the operation member 40 is swung rightward from the neutral position, the control part 41 outputs the electric current I (the control signal) of a predetermined value to a solenoid of the second solenoid valve 34 on the basis of the operation amount θ of the operation member 40. In this manner, the second solenoid valve 34 is opened depending on the electric current value I, and thus the pilot pressure is controlled, the pilot pressure being applied to the second spool 32B of the control valve 32. Accordingly, when the second solenoid valve 34 is operated depending on the operation angle θ of the operation member 40, the second spool 32B of the control valve 32 moves, thereby moving the auxiliary actuator 35 in another direction. Meanwhile, the more the electric current value I increases, the more the solenoid valve is opened widely.

According to the hydraulic system, the first solenoid 33 and the second solenoid 34 are operated in proportion to the operation amount θ of the operation member 40, thereby changing a flow rate of the auxiliary actuator 35.

Figure 3:
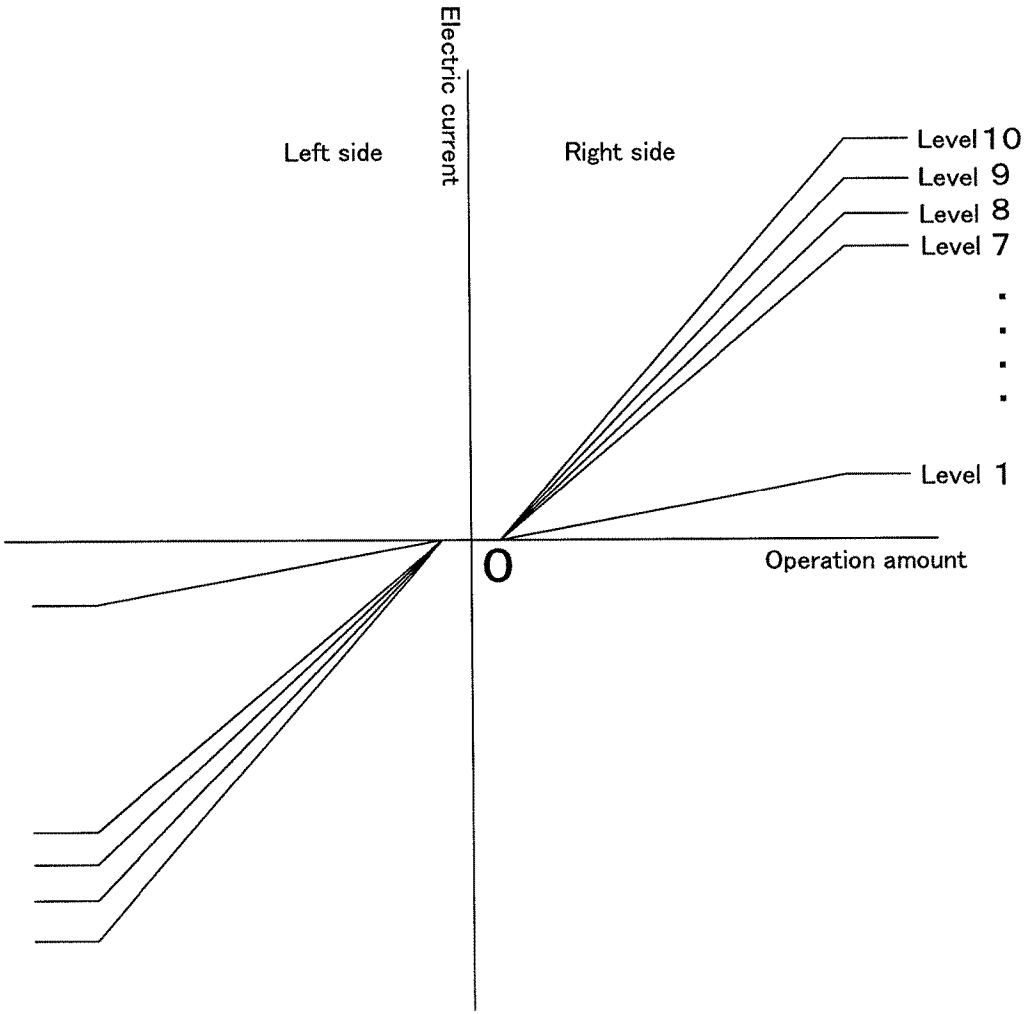
FIG. 3 is a view showing a relationship between an operation amount θ of an operation member and an electric current value according to the first embodiment.

FIG. 3 is a view showing a relationship between the operation amount θ of the operation member 40 and the electric current value outputted by the control part.

As shown in FIG. 3, the control part 41 includes a plurality of electric current values, the electric current values each being outputted when the operation amount θ becomes the maximum (the maximum electric current value). In other words, the control part 41 includes a plurality of control lines each having different slopes, the control lines showing a relationship between the operation amount θ and the electric current value. As shown in FIG. 3, the control part 41 includes ten of the maximum electric current values each being outputted when the operation amount θ becomes the maximum, for example. Hereinafter, for convenience in the example, the largest one of the maximum electric current values corresponds to "Level 10", and "Level 9, Level 8, Level 7, Level 6, Level 5, Level 4, Level 3, Level 2, and Level 1" corresponds to the maximum electric current values in descending order of the maximum electric current values. In FIG. 3, the Level 6 to the Level 2 are omitted. the higher the level is, the larger the slope of the control line shown in FIG. 3 becomes.

For example, in a case where the operation amount θ becomes the maximum at the Level 1, the opening position of the solenoid valve is smaller than the opening position of a case where the operation amount θ becomes the maximum at any one of the Levels larger than the Level 1, and thus the auxiliary actuator 35 can be moved slowly. For example, in a case where the operation amount θ becomes the maximum at the Level 10, the opening position of the solenoid valve is larger than the opening position of a case where the operation amount θ becomes the maximum at any one of the Levels smaller than the Level 10, and thus the auxiliary actuator 35 can be moved quickly.

Then, the level described above and the maximum flow rate corresponding to the level are obtained from an outside.

Next, a method of obtaining the level and the maximum flow rate corresponding to the level will be explained.

As shown in FIG. 1, the working machine 1 includes a first storage part 45 and a first communication part 46. The first storage part 45 is capable of storing the Level (hereinafter also referred to as a setting level) sent from the outside. In addition, the first storage part 45 is capable of storing the maximum flow rate (hereinafter also referred to as a setting flow rate) corresponding to the setting level. Moreover, the first storage part 45 is capable of storing identification information and the like used for identifying the auxiliary actuator 35.

The first communication part 46 is constituted of a device for a short range wireless communication or for a long range wireless communication, and is capable of being connected to an external device. For example, the first communication part 46 is a device configured to carry out a wireless communication, for example, in the Wi-Fi (Wireless Fidelity, registered trademark) of the IEEE802.11 series that is a communication standard. Meanwhile, the first communication part 46 may be a device configured to carry out a wireless communication through a mobile phone communication network and may be a device configured to carry out a wireless communication through a data communication network.

The flow rate setting system of the working machine 1 includes a mobile terminal 50.

The mobile terminal 50 is constituted, for example, of a smartphone (multifunctional mobile phone) or a mobile computer such as a tablet PC, which has a relatively high computing capability. The mobile terminal 50 is capable of obtaining the setting level or the setting flow rate based on the auxiliary attachment, and obtains the setting level or the setting flow rate to send the setting level or the setting flow rate to the working machine 1 (the first communication part 46). The mobile terminal 50 includes a second communication part (an output part) 51, an obtaining part 52, a display part 53, and a second storage part 54.

The second communication part 51 is constituted of a communication device for a wireless communication. The second communication part 51 is a device configured to carry out a wireless communication, for example, in the Wi-Fi (Wireless Fidelity, registered trademark) of the IEEE802.11 series that is a communication standard. In addition, the second communication part 51 is a device configured to carry out a wireless communication through a mobile phone communication network or a data communication network.

The obtaining part 52 obtains the setting level or the setting flow rate, and is constituted of an electronic circuit, a computer program, or the like. The obtaining part 52 includes a first obtaining part 55 and a second obtaining part 56. Each of the first obtaining part 55 and the second obtaining part 56 is constituted of an electronic circuit, a computer program, or the like, for example.

The first obtaining part 55 obtains the identification information used for identifying the auxiliary attachment. The second obtaining part 56 obtains the setting level or the setting flow rate of the auxiliary attachment.

Operations of the first obtaining part 55 and the second obtaining part 56 will be explained below in detail.

Figures 4, 5:
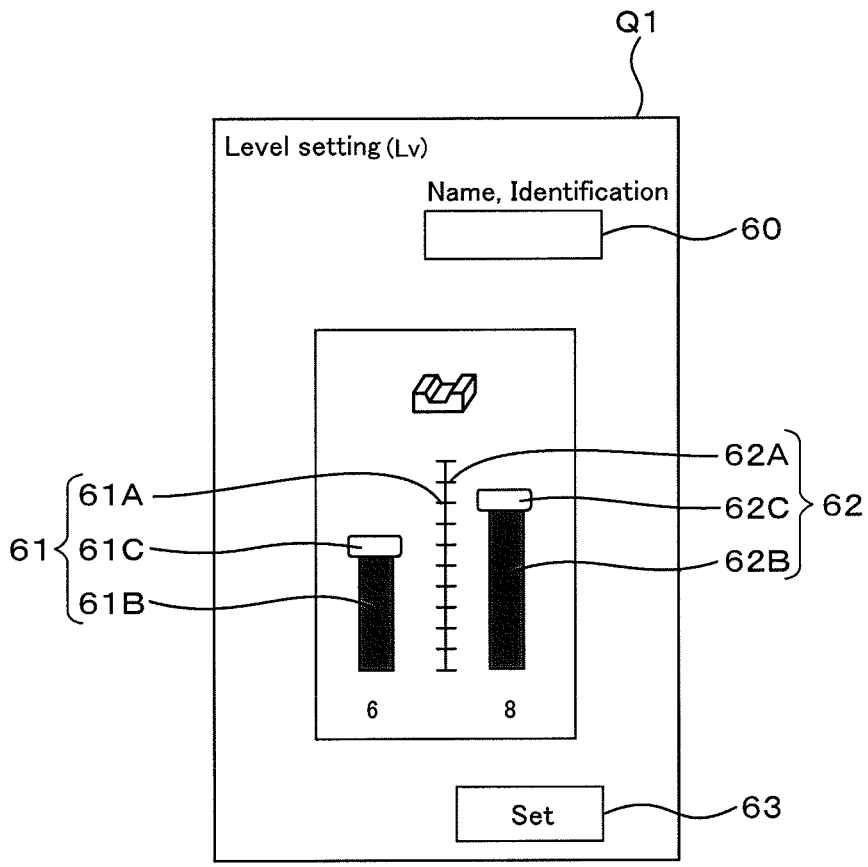
FIG. 4 is a view showing an example of a first screen according to the first embodiment.
FIG. 5 is a view showing a relationship between identification information and a setting level according to the first embodiment.

The obtaining part 52 displays a first screen Q1 on the display part 53 in order to obtain the setting level, the first screen Q1 being shown in FIG. 4.

The first screen Q1 displays a first input part 60 provided for inputting: a name of the auxiliary attachment; or the identification information of the auxiliary attachment. In addition, the first screen Q1 displays a first setting part 61 and a second setting part 62, the first setting part 61 being provided for setting the setting level to the first solenoid valve 33, the second setting part 21 being provided for setting the setting level to the second solenoid valve 34. The first setting part 61 displays a scale part 61A and a first bar 61B, the first bar 61B indicating a present level. A first indication part 61C can move along the scale part 61A, the first indication part 61C being shown at a tip end of the first bar 61B, and the present level is indicated by a position of the first indication part 61C, the position corresponding to the scale part 61A. The Level can be changed by moving the first identification part 61C along the scale part 61A.

The second setting part 62 also displays a scale part 62A and a second bar 62B, the second bar 62B indicating a present level. A second indication part 62C can move along the scale part 62A, the second indication part 62C being shown at a tip end of the second bar 62B, and the present level is indicated by a position of the second indication part 62C, the position corresponding to the scale part 62A. The Level can be changed by moving the second identification part 62C along the scale part 62A.

The first screen Q1 displays a setting button 63.

In selecting the setting button 63, the second obtaining part 56 obtains the present level as the setting level of the first solenoid valve 33, the present level being shown by the first bar 61B, and obtains the present level as the setting level of the second solenoid valve 34, the present level being shown by the second bar 62B. Additionally, in selecting the setting button 63, the first obtaining part 55 obtains: the identification information corresponding to a name of the auxiliary attachment, the name being inputted to the first input part 60; or the identification information of the auxiliary attachment inputted to the first input part 60. Meanwhile, in a case where the identification information is obtained on the basis of the name of the auxiliary attachment, the name of the auxiliary attachment is preliminarily related to the identification information.

The second communication part (an output part) 51 outputs, to the working machine 1 (the first communication part 46): the identification information of the attachment, the identification information being obtained by the first obtaining part 55; and the setting level obtained by the second obtaining part 56. For example, the output part 51 outputs: the identification information inputted to the first screen Q1; and the setting level having been set, in selecting the setting button 63. As described above, necessary information is inputted to the first screen Q1, and thereby the setting level corresponding to the identification information is outputted.

In addition, after relating the identification information and the setting level to each other, the identification information and the setting level related to each other may be outputted to the first communication part 46.

The mobile terminal 50 includes a relation part 57. The relation part 57 relates the identification information and the setting level to each other, the identification information being obtained by the first obtaining part 55, the setting level being obtained by the second obtaining part 56, and is constituted of an electronic circuit or a computer program, for example. For example, in selecting the setting button 63, the relation part 57 relates the identification information and the setting level to each other. The output part 51 outputs the identification information and the setting level to first communication part 46, the identification information and the setting level having been related to each other.

Figures 6, 7:
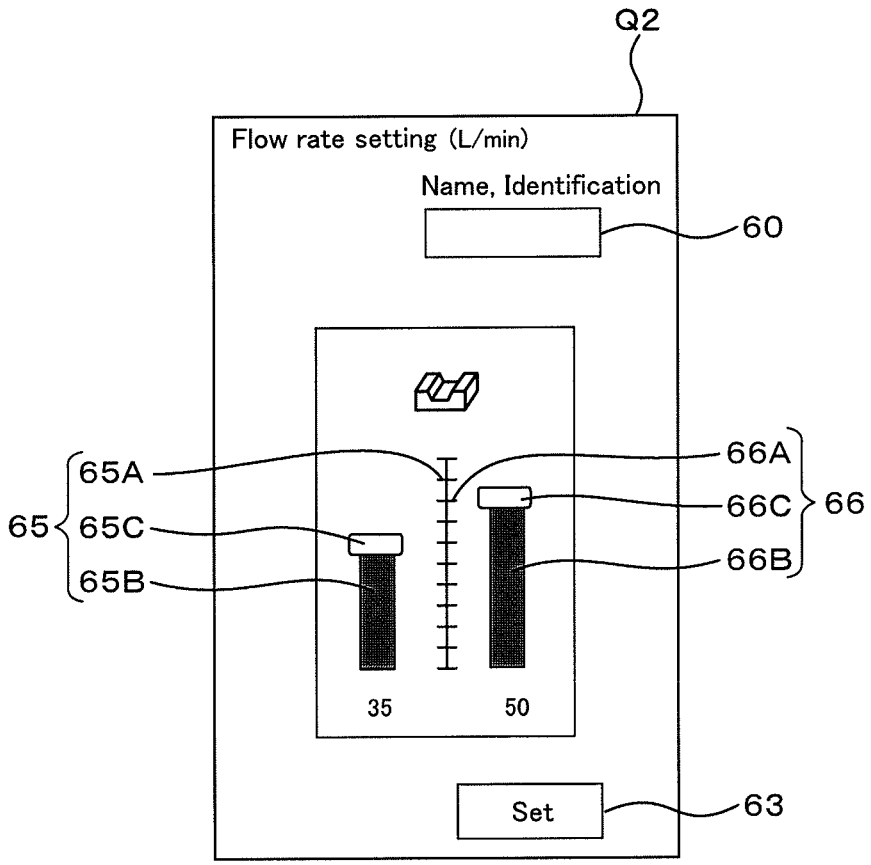
FIG. 6 is a view showing an example of a second screen according to the first embodiment.
FIG. 7 is a view showing a relationship between the identification information and a set flow rate according to the first embodiment.

Meanwhile, in a case of obtaining the setting flow rate instead of the setting level, the obtaining part 52 displays a second screen Q2 on the display part 53, the second screen Q2 being shown in FIG. 6. A modified example will be explained below, the modified example setting the setting flow rate instead of the setting level.

The second screen Q2 also displays the first input part 60. In addition, the second screen Q2 displays a third setting part 65 and a fourth setting part 66, the third setting part 65 being provided for setting the setting flow rate to the first solenoid valve 33, the fourth setting part 66 being provided for setting the setting flow rate to the second solenoid valve 34. The third setting part 65 displays a scale part 65A and a third bar 65B, the third bar 65B indicating a current flow rate. A third indication part 65C can move along the scale part 65A, the third indication part 65C being shown at a tip end of the third bar 65B, and the current flow rate is indicated by a position of the third indication part 65C, the position corresponding to the scale part 65A. The flow rate can be changed by moving the third identification part 65C along the scale part 65A.

The fourth setting part 66 also displays a scale part 66A and a fourth bar 66B, the fourth bar 66B indicating a current flow rate. A fourth indication part 66C can move along the scale part 66A, the fourth indication part 66C being shown at a tip end of the fourth bar 66B, and the current flow rate is indicated by a position of the fourth indication part 66C, the position corresponding to the scale part 61A. The flow rate can be changed by moving the fourth identification part 66C along the scale part 66A.

The second screen Q2 displays the setting button 63.

In selecting the setting button 63, the second obtaining part 56 obtains the current flow rate as the setting flow rate of the first solenoid valve 33, the current flow rate being shown by the third bar 65B, and obtains the current flow rate as the setting flow rate of the second solenoid valve 34, the current flow rate being shown by the fourth bar 66B. Additionally, in selecting the setting button 63, the first obtaining part 55 obtains: the identification information corresponding to a name of the auxiliary attachment, the name being inputted to the first input part 60; or the identification information of the auxiliary attachment inputted to the first input part 60. Meanwhile, in a case where the identification information is obtained on the basis of the name of the auxiliary attachment, the name of the auxiliary attachment is preliminarily related to the identification information.

The output part 51 outputs, to the working machine 1 (the first communication part 46): the identification information of the attachment, the identification information being obtained by the first obtaining part 55; and the setting flow rate obtained by the second obtaining part 56. For example, the output part 51 outputs: the identification information inputted to the second screen Q2; and the setting flow rate having been set, in selecting the setting button 63. As described above, necessary information is inputted to the second screen Q2, and thereby the setting flow rate corresponding to the identification information is outputted.

In addition, as in the case of the setting level, after relating the identification information and the setting flow rate to each other, the identification information and the setting flow rate related to each other may be outputted to the first communication part 46.

For example, in selecting the setting button 63, the relation part 57 relates the identification information and the setting flow rate to each other. The output part 51 outputs the identification information and the setting flow rate to first communication part 46, the identification information and the setting flow rate having been related to each other.

Meanwhile, in the above described embodiment, the identification information and the setting information (the setting level and the setting flow rate) are inputted to the first screen Q1 and the second screen Q2, and thereby the identification information and the setting information each having been inputted are sent to the working machine 1. The identification information and the setting information (the setting level and the setting flow rate) may be registered to the mobile terminal 50.

The mobile terminal 50 includes a registration part 58. The registration part 58 is constituted of an electronic circuit, a computer program, or the like, for example. When the relation part 57 relates the identification information and the setting information to each other, the registration part 58 stores the identification information and the setting information as the registration information to the second storage part 54 of the mobile terminal 50, the identification information and the setting information having been related. That is, the registration part 58 makes the mobile terminal store the identification information and the setting information each inputted to the first screen Q1 or the second screen Q2.

As shown in FIG. 5, the registration part 58 stores the identification information and the setting level as the registration information to the second storage part 54, the identification information and the setting level having been related. And, as shown in FIG. 7, the registration part 58 stores the identification information and the setting flow rate as the registration information to the second storage part 54, the identification information and the setting flow rate having been related.

Figure 8:
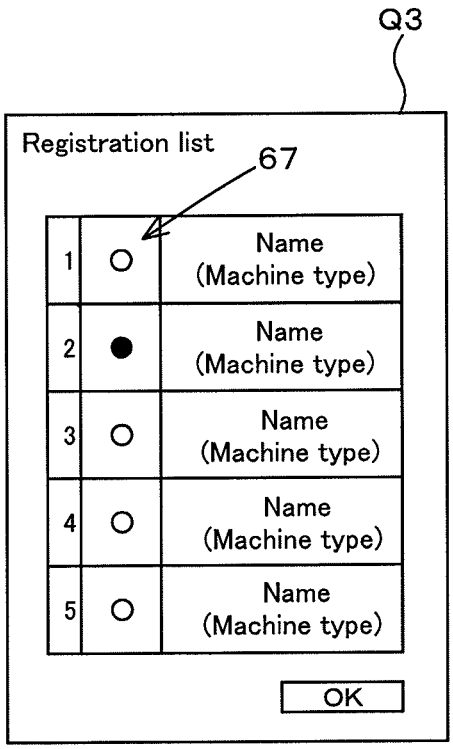
FIG. 8 is a view showing an example of a choice screen according to the first embodiment.

As shown in FIG. 8, after the registration of the setting level or the setting flow rate, the display part 53 is capable of displaying a choice screen Q3 showing a list of registered attachments. Even when the setting level is registered and even when the setting flow rate is registered, the mobile terminal 50 refers to the second storage part 54 and extracts the identification information having been registered. Then, the mobile terminal 50 displays the identification information and a name of the auxiliary actuator 35 on the choice screen Q3, the identification information having been registered, the name corresponding to the identification information.

The choice screen Q3 displays a choice part 67 provided for choosing the auxiliary attachment. Then, it is possible to chose a predetermined attachment. When the auxiliary attachment is chosen, the mobile terminal 50 extracts, from the second storage part 54, the identification information of the auxiliary attachment having been chosen; and the setting level or the setting flow rate each related to the identification information. The second communication part 51 (the output part) sends, to the working machine 1 (the control part 41), the setting level or the setting flow rate each having been extracted; and the identification information.

And, the control part 41 receives: the setting level or the setting flow rate; and the identification information, the setting level, the setting flow rate, and the identification information each being sent from the mobile terminal 50, and then in a case where the auxiliary attachment corresponding to the identification information is attached, the control part 41 validates the setting level or the setting flow rate each received. After that, the control part 41 outputs the control signal to the first solenoid valve 33 and the second solenoid valve 34 on the basis of the setting level or the setting flow rate each validated.

The flow rate setting system of the working machine 1 includes the control part 41 and the mobile terminal 50, and the mobile terminal 50 includes the first obtaining part 55, the second obtaining part 56, and the second communication part (the output part) 51. Accordingly, the attachment and the maximum flow rate can be easily set by using the mobile terminal 50, the attachment being owned by an operator, the maximum flow rate being employed for operation of the attachment. Furthermore, the maximum flow rate can be outputted to the working machine 1 (the control part 41), the maximum flow rate being related to the attachment having been set, and thus the maximum flow rate of the attachment attached to the working machine 1 can be easily set.

On the other hand, the attachment can be easily set by using the mobile terminal 50, and the Level corresponding to the maximum flow rate can be easily set instead of the maximum flaw rate by using the mobile terminal 50, the attachment being owned by an operator. The setting of the Level does not require to set a concrete numerical value in comparison with the setting of the maximum flow rate, and accordingly the setting is easy in comparison with the setting of the maximum flow rate. For example, the flow rate of the hydraulic operation fluid such as 50 L/min is required in the setting of the maximum flow rate; however, the flow rate of the hydraulic operation fluid is shown by stepwise levels in the Level, and thus the setting can be completed even when a concrete flow rate of the hydraulic operation fluid is not known. For example, equally dividing the maximum flow rate supplied when the operation member is fully operated, and showing each of divided steps by the Levels, the setting by the Levels can be carried out.

Also in a case where the Level has been set, the Level related to the attachment can be outputted to the working machine 1 (the control part 41) as in the case where the maximum flow rate has been set, and thus the maximum flow rate of the attachment can be easily set, the attachment being attached to the working machine 1. In particular, in a case where the mobile terminal 50 includes the relation part 57, the identification information and the setting information (the setting level and the setting flow rate) can be sent in combination, and accordingly a process of the setting can be easily carried out on a side of the working machine 1.

In addition, the mobile terminal 50 includes the registration part 58, and thus the maximum flow rate and the Level can be registered for each of the identification information of the attachments even in a case where an operator owns a plurality of attachments. In particular, the operator may own a plurality of identical attachments. The maximum flow rate and the Level can be registered for each of the attachments even in a case where the operator owns the plurality of identical attachments.

The display part 53 is capable of displaying: the identification information and the maximum flow rate related to each other by the relation part 57; or the name of and the maximum flow rate of the attachment obtained from the identification information, the identification information being related to the attachment by the relation part 57. In addition, the display part 53 is capable of displaying: the identification information and the Level related to each other by the relation part 57; or the name of and the Level of the attachment obtained from the identification information, the identification information being related to the attachment by the relation part 57. In this manner, the operator can easily know: the attachment; and the maximum flow rate of or the Level of the attachment, only by watching the display part 53 of the mobile terminal 50.

The display part 53 displays the choice part 67 provided for choosing the attachment. Then, the output part 51 outputs the identification information and the maximum flow rate, the identification information corresponding to the attachment chosen by using the choice part 67, the maximum flow rate being related to the identification) information. Or, the output part 51 outputs the identification information and the Level, the identification information corresponding to the attachment chosen by using the choice part 67, the Level being related to the identification information. Accordingly, the maximum flow rate of and the Level of an attachment can be set only by choosing the attachment displayed on the display part, the attachment being attached to the working machine 1.

Second Embodiment

In the first embodiment, the identification information of and the name of the auxiliary attachment are inputted to the first screen Q1 and the second screen Q2 in the setting. In the second embodiment of the present invention, a code is preliminarily provided to the auxiliary attachment, the code being provided for reading information such as the identification information and the setting level, and the setting is carried out by reading the code. The second embodiment of the present invention will be described below. In the second embodiment, explanation of the configurations same with the configurations of the first embodiment is omitted.

A QR code (a registered trademark) is attached on a surface of the auxiliary attachment, the QR code including:

the identification information of the auxiliary attachment; and the setting level preliminarily determined. Meanwhile, the QR code (a registered trademark) may include the setting flow rate instead of the setting level.

Figure 9:
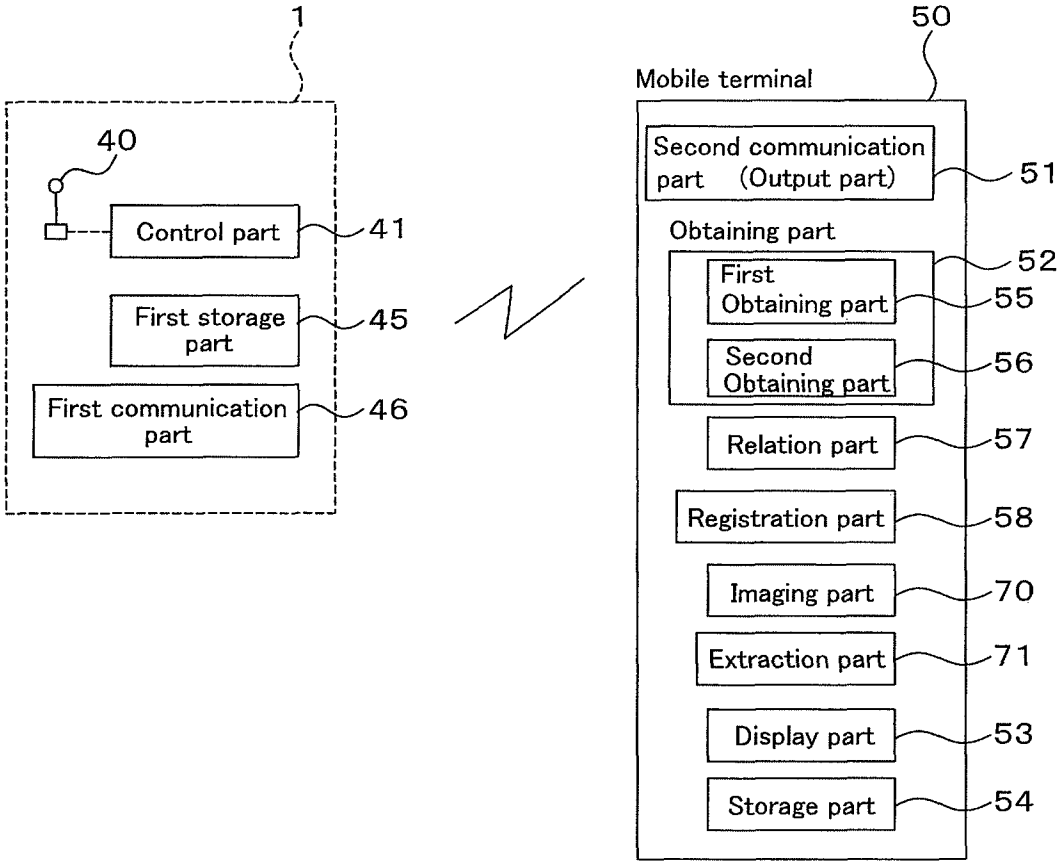
FIG. 9 is a an overall view of a flow rate setting system for a working machine according to a second embodiment of the present invention.

As shown in FIG. 9, the mobile terminal 50 includes an image part 70 and an extraction part 71. The image part 70 is constituted of a CCD camera or the like and is capable of imaging the QR code (a registered trademark). The extraction part 71 is constituted of an electronic circuit, a computer program, or the like. The extraction part 71 extracts: the identification information of the auxiliary attachment; and the setting level or the setting flow rate, from an image of the QR code (a registered trademark) imaged by the image part 70.

Then, the setting of the setting level or the setting flow rate will be explained in detail.

Figure 10:
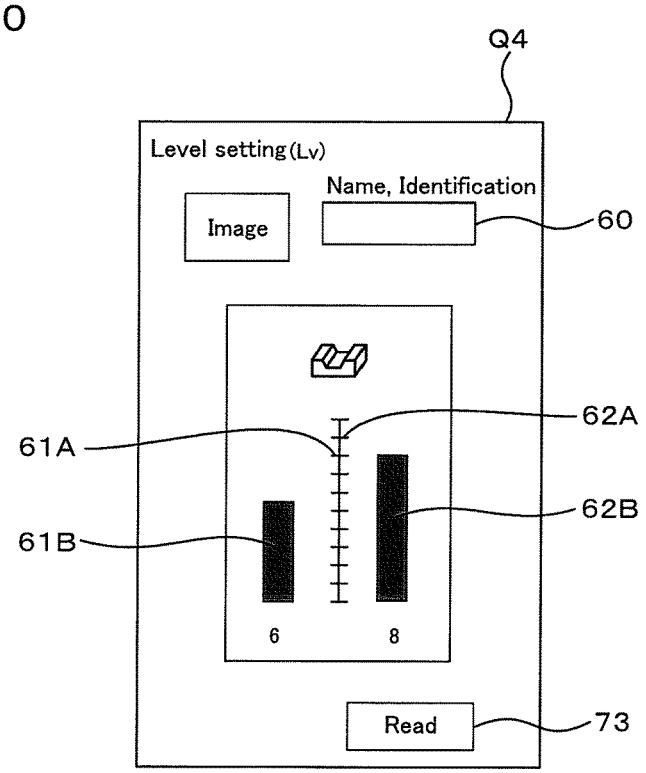
FIG. 10 is a view showing an example of a third screen provided for setting a standard level according to the second embodiment.

As shown in FIG. 10, the display part 53 is capable of displaying the third screen Q4. The third screen Q4 is capable of displaying the setting level and the setting flow rate, whichever is needed.

The third screen Q4 displays a read button 73 provided for reading the QR code (a registered trademark). When the read button is selected, the mobile terminal 50 is switched into a mode for reading the QR code (a registered trademark), and is capable of imaging the QR code (a registered trademark) by using the image part 70.

The extraction part 71 extracts the information included in the QR code (a registered trademark), after the QR code (a registered trademark) is imaged. For example, the extraction part 71 extracts the setting level (referred to as a standard level) shown in the QR code (a registered trademark), in a case where the QR code (a registered trademark) includes the setting level. Then, when the extraction part 71 extracts the standard level, the third screen Q4 displays the first setting part 61 and the second setting part 62. Then, the standard level shown in the QR code (a registered trademark) is displayed as a present level on the first bar 61B of the first setting part 61 and on the second bar 62B of the second setting part 62. Here, in a case where the read button 73 displayed on the third screen Q4 is selected, the second obtaining part 56 is capable of obtaining the present level (the standard level) shown by the first bar 61B, and is capable of obtaining the present level (the standard level) shown by the second bar 62B. The relation part 57 relates the identification information of the attachment and the standard level to each other, the identification information being obtained by the first obtaining part 55, the standard level being obtained by the second obtaining part 56.

Meanwhile, the QR code (a registered trademark) includes, as the information, the setting level preliminarily determined, that is, the standard level before the auxiliary attachment is operated; however, the standard level may be changed in the third screen Q4.

Figure 11:
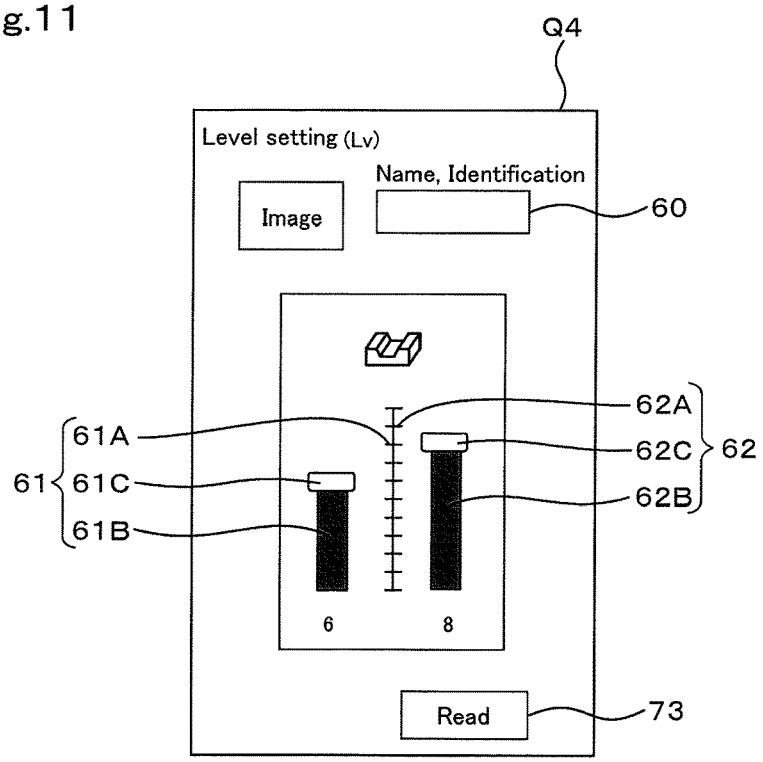
FIG. 11 is a view showing an example of the third screen capable of changing the standard level according to the second embodiment.

As shown in FIG. 11, the third screen Q4 displays the first indication part 61C on the first bar 61B, and displays the second indication part 62C on the second bar 62B. As described above, the first indication part 61C is capable of moving along the scale part 61A, the second indication part 62C is capable of moving along the scale part 62A, and thus the present level can be changed. The present level is changed by using the first indication part 61C and the second identification part 62C, and thereby the standard level preliminarily determined by the QR code (a registered trademark) is changed.

The second embodiment described above explains the setting of the setting level, the setting being carried out by reading the QR code (a registered trademark); however, the setting flow rate may be set instead of the setting level.

Figure 12:
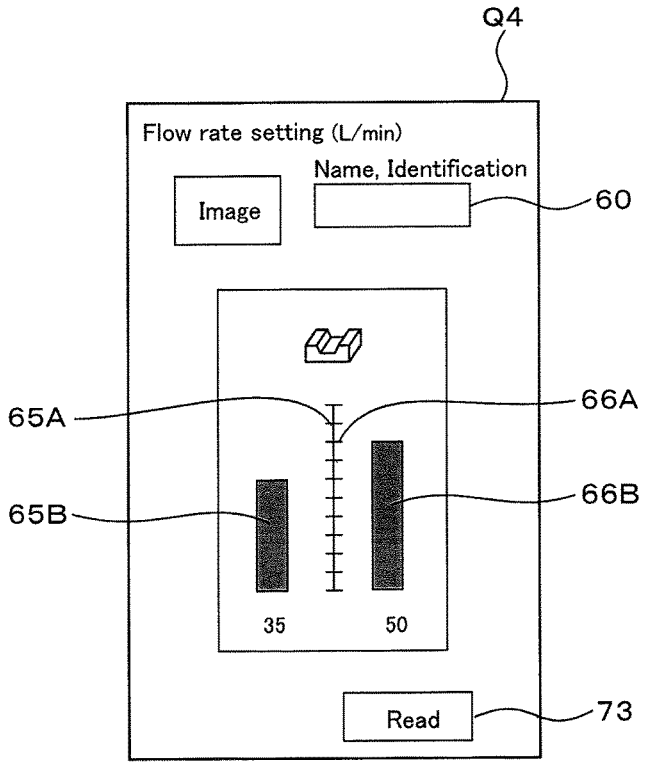
FIG. 12 is a view showing an example of the third screen provided for setting a standard flow rate according to the second embodiment.

In a case where the setting flow rate is included in the QR code (a registered trademark), the setting flow rate (referred to as a standard flow rate) shown in the QR code (a registered trademark) is extracted after the QR code (a registered trademark) is imaged. And, in a case where the extraction part 71 extracts the standard flow rate, the third screen Q4 displays the third setting part 65 and the fourth setting part 66 as shown in FIG. 12. Then, the standard flow rate shown in the QR code (a registered trademark) is displayed as the current flow rate on the third bar 65B of the third setting part 65 and on the fourth bar 66B of the fourth setting part 66. Here, in a case where the setting button 63 displayed on the third screen Q4 is selected, the second obtaining part 56 is capable of obtaining the current flow rate (the standard flow rate) shown by the third bar 65B, and is capable of obtaining the current flow rate (the standard flow rate) shown by the fourth bar 66B. The relation part 57 relates the identification information of the attachment and the standard flow rate to each other, the identification information being obtained by the first obtaining part 55, the standard flow rate being obtained by the second obtaining part 56.

Figure 13:
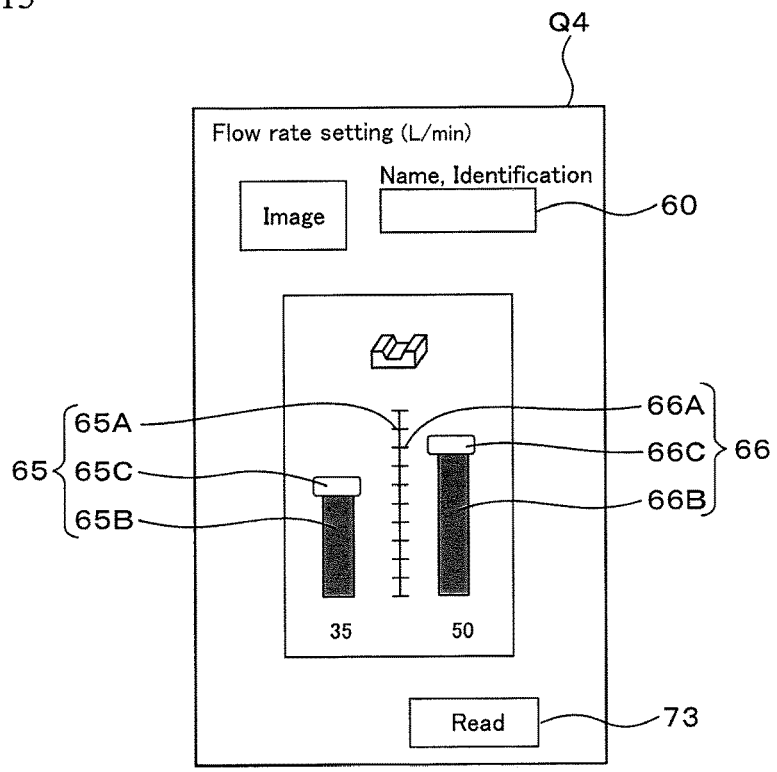
FIG. 13 is a view showing an example of the third screen capable of changing the standard flow rate according to the second embodiment.

Meanwhile, the standard flow rate may be changed in the third screen Q4 as with the standard level. In that case, as shown in FIG. 13, the third screen Q4 displays the third indication part 65C on the third bar 65B, and displays the fourth indication part 66C on the fourth bar 66B. As described above, the third indication part 65C and the fourth indication part 66C are capable of moving along the scale part 61A, and are capable of changing the current flow rate. The current flow rate is changed by using the third identification part 65C and the fourth identification part 66C, and thereby the standard flow rate preliminarily determined by the QR code (a registered trademark) is changed.

Meanwhile, the image part 70 of the mobile terminal 50 is capable of imaging the auxiliary attachment other than the QR code (a registered trademark). The image of the auxiliary attachment imaged by the image part 70 can be related to the identification information and the setting level by the relation part 57. In addition, the image of the auxiliary attachment can be related to the identification information and the setting flow rate by the relation part 57. For example, as described above, when the QR code (a registered trademark) is read after the image part 70 images the auxiliary attachment, the third screen Q4 displays the image (a picture) having been imaged, as shown in FIG. 10 to FIG. 13. Then, in a case where the setting button 63 is selected in the third screen Q4, the relation part 57 relates the image shown in the third screen Q4, the setting information (the setting level and the setting flow rate), and the identification information to each other. The image, the setting information (the setting level and the setting flow rate), and the identification information related to each other are stored as a registration information to the second storage part 54.

Figure 14:
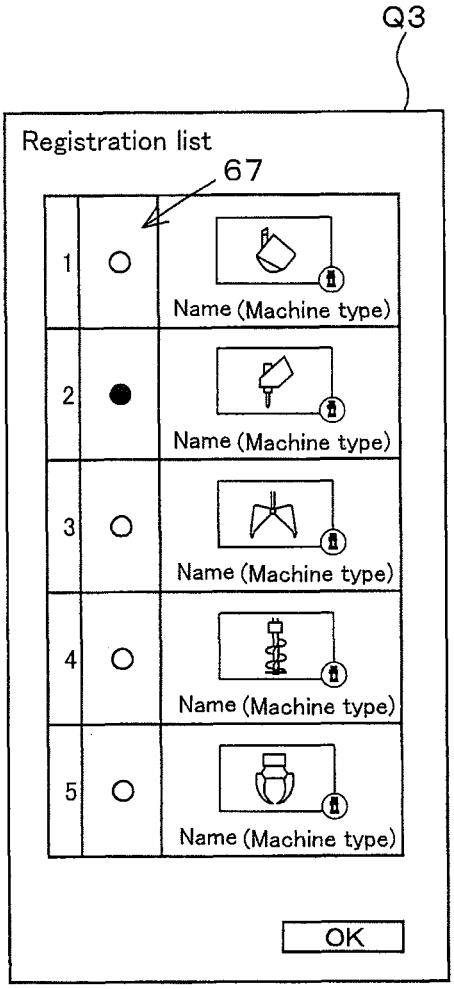
FIG. 14 is a view showing another example of the choice screen according to the second embodiment.

In that case, as shown in FIG. 14, the choice screen Q3 is capable of displaying a list of the registration information (the image, the setting information, and the identification information). In the choice screen Q3, the image displayed on the choice screen Q3 can be chosen as the choice part 67, the choice part 67 being provided for choosing the auxiliary attachment. When the image of the auxiliary attachment is chosen by the tapping or the like, the mobile terminal 50 extracts, from the second storage part 54, the identification information of the auxiliary attachment; and the setting level or the setting flow rate each related to the identification information, the identification information corresponding to the image having been chosen. The second communication part 51 (the output part) sends, to the working machine 1 (the control part 41), the setting level or the setting flow rate; and the identification information, the setting level or the setting flow rate each having been extracted.

According to the flow rate setting system of the working machine 1, the mobile terminal 50 includes the image part 70 and the extraction part 71. In this manner, the maximum flow rate of and the Level of the attachment can be set and registered only by imaging the code by using the image part 70, the code being attached on the attachment.

In addition, the image part 70 is capable of imaging the attachment separately from the code (the QR code (a registered trademark), and the relation part 57 relates the identification information, the setting information (the setting level and the setting flow rate), and the image of the attachment to each other, the image being obtained by the image part 70. In this manner, the display part 53 is capable of displaying: the image of the attachment; and the setting information, for example, and an operator is capable of setting the maximum flow rate and the Level, watching the image.

In the above description, the embodiment of the present invention has been explained. However, all the features of the embodiment disclosed in this application should be considered just as examples, and the embodiment does not restrict the present invention accordingly. A scope of the present invention is shown not in the above-described embodiment but in claims, and is intended to include all modifications within and equivalent to a scope of the claims.

What is claimed is:

1. A flow rate setting system of a working machine, comprising:

an attachment configured to be attached to the working machine;

a control part configured to control a flow of hydraulic operation fluid based on a maximum flow rate of the hydraulic operation fluid being to be supplied to the attachment, the control part being mounted on the working machine;

a code disposed on a surface of the attachment, the code showing: identification information of the attachment; and information showing a maximum flow rate of the attachment; and a mobile terminal configured to communicate in wireless communication, the mobile terminal including:

a camera;

a first obtaining part configured to obtain the identification information of the attachment from an image of the code taken by the camera;

a second obtaining part configured to obtain the maximum flow rate of the attachment from the image of the code taken by the camera; and an output part configured to output the identification information and the maximum flow rate to the working machine in the wireless communication, the identification information being obtained by the first obtaining part, the maximum flow rate being obtained by the second obtaining part.

2. The flow rate setting system of a working machine according to claim 1, wherein the mobile terminal includes:

a relation part configured to relates the identification information of the attachment and the maximum flow rate to each other, the identification information being obtained by the first obtaining part, the maximum flow rate being obtained by the second obtaining part, and the output part outputs the identification information and the maximum flow rate both related to each other by the relation part.

3. The flow rate setting system of a working machine according to claim 2, wherein the camera images the attachment separately from the code, and the relation part relates the identification information, the maximum flow rate, and an image of the attachment to each other, the image being taken by the camera.

4. The flow rate setting system of a working machine according to claim 1, wherein the mobile terminal includes:

a registration part configured to register the identification information and the maximum flow rate, and the output part outputs the identification information and the maximum flow rate each registered by the registration part.

5. The flow rate setting system of a working machine according to claim 1, wherein the mobile terminal includes:

a display part configured to display: the identification information and the maximum flow rate each registered by the registration part; or a name of the attachment and the maximum flow rate each obtained from the identification information, the identification information being related to the maximum flow rate by the relation part.

6. The flow rate setting system of a working machine according to claim 5, wherein the display part displays a choice part used for choosing the attachment, and the output part outputs: the identification information corresponding to the attachment chosen by the choice part; and the maximum flow rate related to the identification information.

7. A flow rate setting system of a working machine, comprising:

an attachment configured to be attached to the working machine;

a control part configured to control a flow of hydraulic operation fluid based on a level corresponding to a maximum flow rate of the hydraulic operation fluid being to be supplied to the attachment, the control part being mounted on the working machine;

a code disposed on a surface of the attachment, the code showing: identification information of the attachment; and information showing the level of the attachment; and a mobile terminal configured to communicate in wireless communication, the mobile terminal including:

a camera;

a first obtaining part configured to obtain the identification information of the attachment from an image of the code taken by the camera;

a second obtaining part configured to obtain the level of the attachment from the image of the code taken by the camera; and an output part configured to output the identification information and the level to the working machine in the wireless communication, the identification information being obtained by the first obtaining part, the level being obtained by the second obtaining part.

8. The flow rate setting system of a working machine according to claim 7, wherein the mobile terminal includes:

a relation part configured to relates the identification information of the attachment and the level to each other, the identification information being obtained by the first obtaining part, the level being obtained by the second obtaining part, and the output part outputs the identification information and the level both related to each other by the relation part.

9. The flow rate setting system of a working machine according to claim 8, wherein the camera images the attachment separately from the code, and the relation part relates the identification information, the level, and an image of the attachment to each other, the image being taken by the camera.

10. The flow rate setting system of a working machine according to claim 7, wherein the mobile terminal includes:

a registration part configured to register the identification information and the level, and the output part outputs the identification information and the level each registered by the registration part.

11. The flow rate setting system of a working machine according to claim 7, wherein the mobile terminal includes:

a display part configured to display: the identification information and the level each registered by the registration part; or a name of the attachment and the level each obtained from the identification information, the identification information being related to the level by the relation part.

12. The flow rate setting system of a working machine according to claim 11, wherein the display part displays a choice part used for choosing the attachment, and the output part outputs: the identification information corresponding to the attachment chosen by the choice part; and the level related to the identification information.

* * * * *